United States Patent [19]

de Keijzer

[11] Patent Number: 4,473,772

[45] Date of Patent: Sep. 25, 1984

[54] COLOR DISPLAY TUBE HAVING IMPROVED COLOR SELECTION STRUCURE

[75] Inventor: Abraham A. de Keijzer, Eindhoven, Netherlands

[73] Assignee: U.S. Philips Corporation, New York, N.Y.

[21] Appl. No.: 369,959

[22] Filed: Apr. 19, 1982

[30] Foreign Application Priority Data

May 6, 1981 [NL] Netherlands ..... 8102200

[51] Int. Cl.[3] ..... H01J 29/81

[52] U.S. Cl. ..... 313/402; 313/403; 313/460

[58] Field of Search ..... 313/402, 403, 460; 315/1

[56] References Cited

U.S. PATENT DOCUMENTS

| | | | |
|---|---|---|---|
| 4,066,923 | 1/1978 | van Esdonk | 313/402 |
| 4,107,569 | 8/1978 | Ronde | 313/402 |
| 4,121,131 | 10/1978 | van Esdonk et al. | 313/402 |
| 4,188,562 | 2/1980 | Van Oostrum | 313/402 |
| 4,311,944 | 1/1982 | Bloom et al. | 313/403 X |
| 4,316,126 | 2/1982 | Hockings et al. | 313/403 X |
| 4,350,922 | 9/1982 | Catanese et al. | 313/402 |
| 4,427,918 | 1/1984 | Lipp | 313/402 |

*Primary Examiner*—Eugene R. LaRoche
*Assistant Examiner*—Vincent De Luca
*Attorney, Agent, or Firm*—Joseph P. Abate

[57] ABSTRACT

In a color display tube of the post focusing type, the color selection structure (7) includes first lens electrode means (11) and second lens electrode means (12) situated at a short distance from each other. The second lens electrode means has a number of elongate conductors (12) or groups of conductors (12) extending parallel to each other. The conductors (12) or groups of conductors (12) are interconnected via a resistance material (19) as a result of which the energy released in an electric flash-over between the lens electrode means (11) and a conductor (12) in the flash-over point per unit of time is so small that the color selection structure (7) is not seriously damaged.

13 Claims, 6 Drawing Figures

COLOR DISPLAY TUBE HAVING IMPROVED COLOR SELECTION STRUCURE

BACKGROUND OF THE INVENTION

The present invention relates to a color display tube comprising, in an evacuated envelope, means for generating a number of electron beams, a display screen having a large number of areas luminescing in different colors when struck by the beams, and a color selection structure positioned between the screen and the beam generating means, the structure comprising a multiplicity of apertures for associating each electron beam with luminescent areas of one color, the color selection structure further comprising first and second lens electrode means, situated at a defined distance from each other, for focusing the electron beams passing through each aperture.

Such a display tube is known from U.S. Pat. No. 4,107,569. By applying an electric potential difference between the first and the second lens electrode means, a focusing effect is exerted on the electron beams passing through each of the apertures of the color selection structure. Such display tubes are therefore, sometimes referred to as "post-focusing tubes". The color selection takes place in a manner analogous to that in a color display tube which is equipped with a normal shadow mask. As a result of the electric potential difference between the first and second lens electrode means situated at a short distance from each other, electric flash-over may occur during operation of the tube between an electrode of the first and an electrode of the second lens electrode means. When such a flash-over occurs, the total electric energy stored in the color selection structure may be released in the flash-over point in fractions of a second so that damage may be done to the color selection structure at that area.

SUMMARY OF THE INVENTION

It is an object of the invention to provide a color display tube of the kind mentioned in the opening paragraph in which measures are taken which minimize the detrimental results of an electric flash-over occurring in the color selection structure.

For that purpose, according to the invention, a color display tube having in an evacuated envelope means for generating a number of electron beams, a display screen having a large number of areas luminescing in different colors, and a color selection structure having a multiplicity of apertures for associating each electron beam with luminescent regions of one color, said color selection structure comprising first and second lens electrode means situated at a defined distance from each other, is characterized in that at least one of these lens electrode means comprises a plurality of elongate conductors or groups of elongate conductors extending parallel to each other (i.e. mutually parallel) which conductors or groups of conductors are interconnected via an electric resistance material.

In case of an electric flash-over, if any, in the color selection structure of a display tube made in accordance with the invention, the discharge current of the capacitor formed in combination by the first and second lens electrode means is bounded by the resistance material which is incorporated in the electric connection path of the elongate conductors or groups of conductors. The energy released in the flash-over point per unit of time thus is too small to be able to damage the color selection structure. By providing said resistance material, the capacitor formed by the color selection structure is divided into a number of parallel connected partial capacitors which are interconnected via resistors. The energy stored in each of the partial capacitors in the case of a flash-over within said partial capacitor will not lead to damage of the color selection structure. The product of the capacity (capacitance) of a partial capacitor and the square of the voltage difference between the first and second lens electrode means will therefore not exceed a given critical value. This critical value depends on the construction of the color selection structure. It can be established experimentally, however, into how many partial capacities the overall capacity of the color selection structure has to be subdivided so as not to have detrimental results because of an electric flash-over. The smallest partial capacity is obtained when each of the elongate conductors is connected to another elongate conductor via a resistor. It is also possible and sometimes desirable to divide the conductors into groups of interconnected conductors and to interconnect said groups via resistors. The capacity of a partial capacitor is, in this case, determined by the number of elongate conductors in a group.

According to an embodiment of the invention, the elongate conductors or groups of elongate conductors are connected to a common voltage supply conductor via an electric resistance material. The desired resistance values can be obtained with discrete resistors or in the form of a layer of resistance material. These resistance values are not particularly critical and depend inter alia on the dimensions of the color selection structure.

The minimum resistance value is determined by the current strength occurring in an electric flash-over in the flash-over point, which current strength is still permissible. According to another embodiment, therefore the resistance between two adjacent elongate conductors or between two adjacent groups of elongate conductors is at least substantially 2000 Ohms.

Preferably, an upper limit is also imposed on said resistance values so as to prevent too large potential variations from occurring in the color selection structure as a result of, for example, dissipating secondary electrons which impinge on the elongate conductors. For this reason, according to a further embodiment, the resistance values are chosen to be not higher than substantially $500\times10^3$ Ohm.

BRIEF DESCRIPTION OF THE DRAWING

Embodiments of the invention will now be described in greater detail, by way of example, with reference to the accompanying drawings, in which.

DESCRIPTION OF THE PREFERRED EMBODIMENTS

Figure 1:
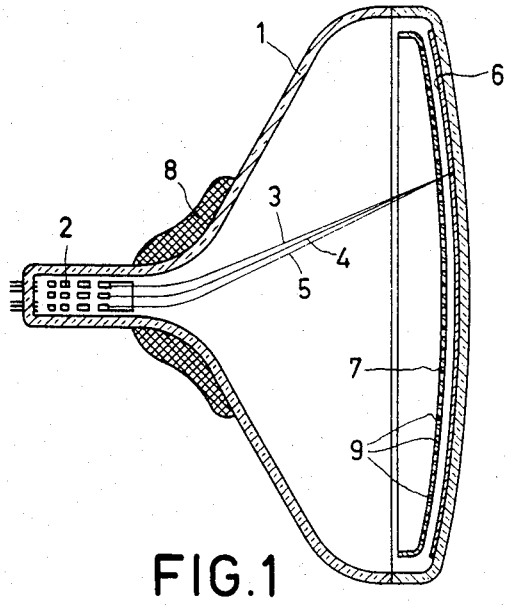
FIG. 1 is a sectional view of a color display tube according to the invention, having a color selection structure comprising elongate conductors which are interconnected.

The tube shown in FIG. 1 comprises a glass envelope 1, means 2 for generating three electron beams 3, 4 and 5, a display screen 6, color selection structure 7 and deflection coils 8. The electron beams 3, 4 and 5 are generated in one plane, the plane of the drawing of FIG. 1, and are deflected over the display screen 6 by means of the deflection coils 8. The display screen 6 consists of a large number of phosphor strips luminescing in red, green and blue when struck by the beams. The longitudinal direction of the screen is perpendicular to the plane of the drawing of FIG. 1. During normal operation of the tube, the phosphor strips are vertical and FIG. 1 thus, is a horizontal sectional view of the tube. The color selection structure 7 comprises a multiplicity of apertures 9 which are shown diagrammatically in FIG. 1. The three electron beams 3, 4 and 5 pass through the apertures 9 at a small angle with each other and consequently each impinges only on phosphor strips of one color, each beam being associated with a different color. The apertures 9 in the color selection structure 7 are thus very accurately positioned relative to the phosphor strips of the display screen 6. As described in U.S. Pat. No. 4,107,569, the color selection structure comprises first and second lens electrode means, and a focusing effect is exerted on the electron beams 3, 4 and 5 passing through each of the apertures 9. The first and second lens electrode means for that purpose have an electric potential difference with respect to each other of approximately 2000 V. As shown in detail in FIGS. 2 and 3, the first electrode means comprises a metal plate 11 having rows of apertures 9. The second lens electrode means comprises a number of elongate conductors 12 extending parallel to each other and kept at a distance of approximately 100 μm from the metal plate 11 by means of glass beads 13. The conductors 12 are positioned between the rows of apertures 9 and the beads 13 are connected by means of an enamel on the one hand to the conductors 12 and on the other hand to the plate 11. The apertures 9 are 475×570 μm and their pitch is 775 μm so that the transmission of the color selection structure is approximately 50%.

The display screen 6 and the metal plate 11 are electrically connected and during operation of the display tube receive a voltage of approximately 25 kV while a voltage of approximately 23 kV is applied to the conductors 12. As a result of this voltage difference, a quadrupole lens field is formed in each of the apertures 9 in such manner that an electron beam passing through an aperture 9 is focused in one direction and is defocused in a direction at right angles to said one direction. As a result of this, an elongate spot is obtained on the display screen 6 the long axis of which spot is parallel to the phosphor strips on the display screen 6.

As a result of the potential difference of approximately 2000 V between the conductors 12 and metal plate 11 situated at a short distance from each other, an electric flash-over may occur between a conductor 12 and the plate 11 which, in the flash-over point, can seriously damage in particular the conductor 12 which is only 250 μm wide and 100 μm thick. In fact, the conductors 12 and the metal plate 11 together constitute a capacitor which discharges at such a flash-over. For example, for a color selection electrode structure of 38×52 cm, said capacitor has a capacity of approximately 10 nF. Although the energy stored in said capacitor at the given voltage of 2000 V is only a few tens of milli-Joules, when the conductors 12 are interconnected in a low-ohmic manner, said energy may be released in the flash-over point in fractions of a second.

Figure 2:
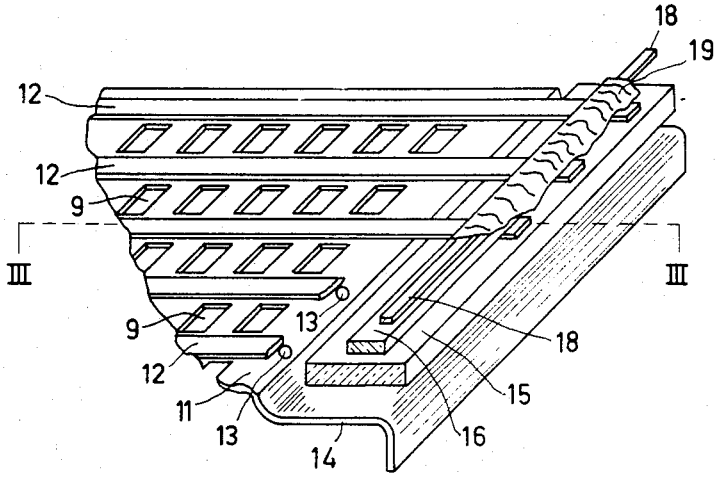
FIG. 2 is a perspective view of a detail of the color selection structure shown in FIG. 1.
Figure 3:
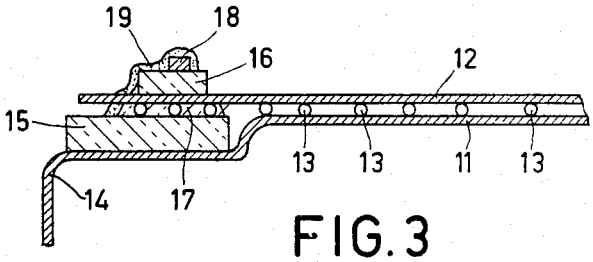
FIG. 3 is a sectional view taken on the line III—III of the color selection structure shown in FIG. 2.

In a display tube according to the invention, the detrimental results of an electric flash-over are restricted by interconnecting the conductors 12 in a high-ohmic manner so that the discharge current in the flash over point is limited to a permissible value. FIGS. 2 and 3 show a possible construction with which this can be realized. The plate 11 comprises at its edge a step-shaped strip 14 on which a strip 15 of insulating material, for example, glass or ceramic, is connected. The conductors 12 project beyond the plate 11 and bear on the strip 15. A second strip 16 of insulating material (glass or ceramic) is connected to the strip 15 by means of an adhesive 17, for example, a connection cement; the conductors 12 being also connected between the strips 15 and 16. A voltage supply conductor 18 which is common to the conductors 12 is connected to the strip 16. The high-ohmic connection between the conductors 12 is obtained by means of a layer of resistance material 19 which is in the form of a suspension and which also provides a high-ohmic connection between the conductors 12 and the common supply conductor 18. In the embodiment described, the layer 19 in the dried condition consists of approximately 21% by weight of sodium silicate or potassium silicate, 63% by weight of iron oxide ($Fe_2O_3$) and 16% by weight of graphite. Herewith, a resistance of $25\times10^3$ to $100\times10^3$ Ohm is obtained between adjacent conductors 12 which resistance restricts the current strength occurring in the case of a flash-over in the flash-over point to a few milliampères.

Figure 4:
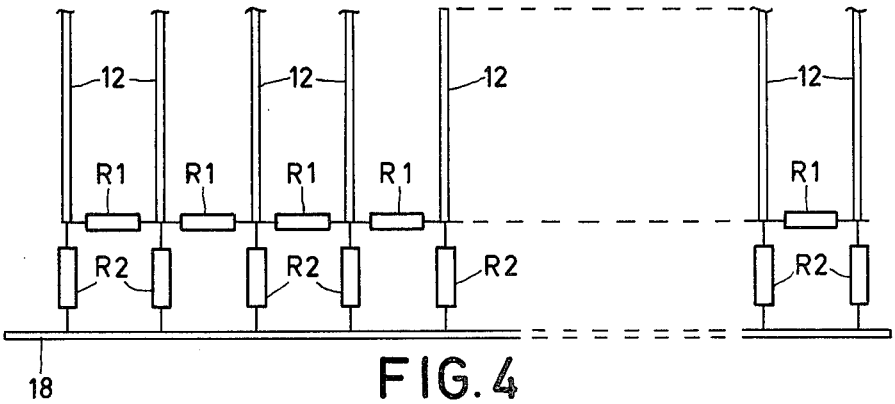
FIG. 4 shows diagrammatically the electric connection of the elongate conductors shown in FIGS. 2 and 3.

FIG. 4 shows diagrammatically how the elongate conductors are coupled together and to the common supply conductor 18 according to the construction shown in FIGS. 2 and 3. The resistors $R_1$ denote the resistance obtained by the resistance layer 19 between two adjacent conductors 12. The resistors $R_2$ indicate the resistance between a conductor 12 and the common conductor 18 obtained by the resistance layer 19. The resistors $R_1$ and $R_2$ are of the same order of magnitude and have a value between $25\times10^3$ and $100\times10^3$ Ohm.

Figure 5:
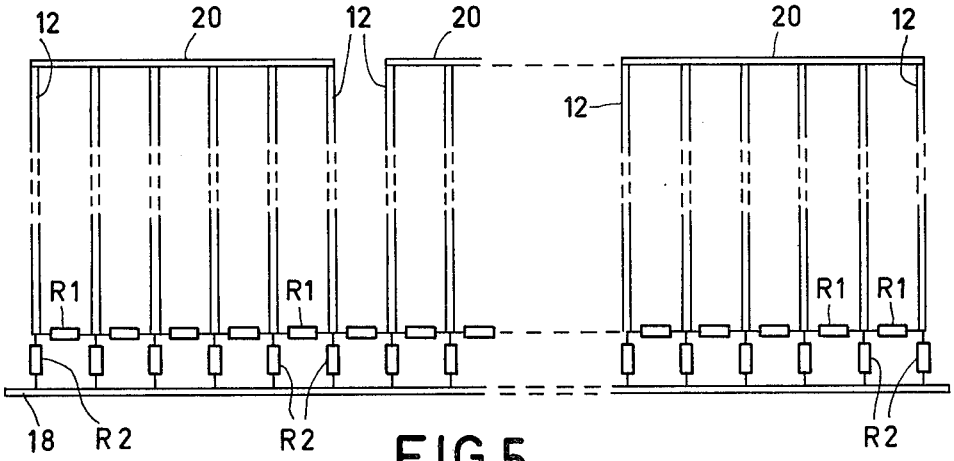
FIG. 5 shows diagrammatically an embodiment of conductors connected in groups.
Figure 6:
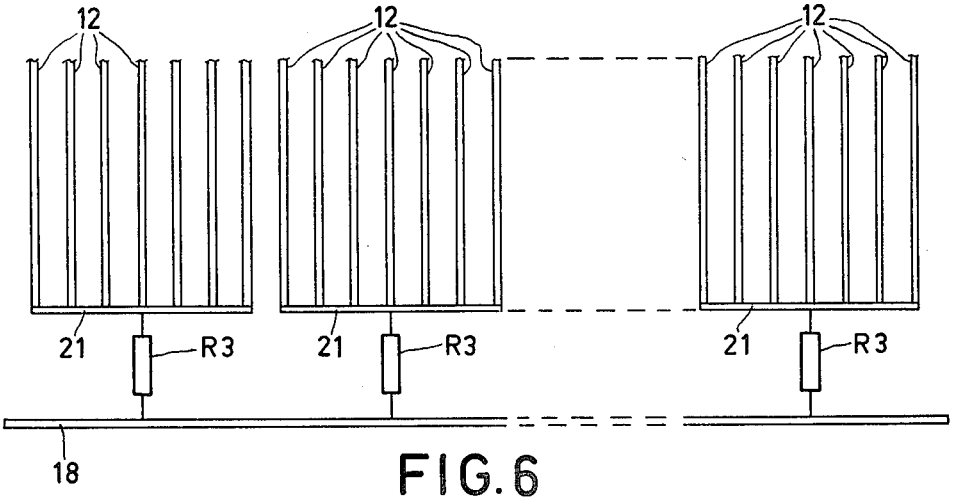
FIG. 6 shows diagrammatically another embodiment of conductors connected in groups.

As already stated, it may be desirable to divide the elongate conductors 12 into groups of conductors and to interconnect said groups via resistors. In the construction shown in FIGS. 2 and 3, this division into groups can simply be realized by providing short-circuit strips at the ends of the conductors 12 not shown in FIG. 2, each of which strips connects a number of conductors to form a group. In FIG. 5, said short-circuit strips are referenced 20. Another embodiment of conductors connected in groups is shown diagrammatically in FIG. 6. The short-circuit strips 21 shown in said figure are connected to the common supply conductors 18 via resistors R3. The connection in groups of the conductors 12, that is to say the division into larger partial capacities of the overall capacities of the color selection structure may be necessary in connection with dust particles or other contaminations which may form a source of the formation of an electric flash-over. A partial capacity and therewith the energy released in the flash-over point per unit of time is then on the one hand large enough to burn away such an impurity, but on the other hand is too small to damage the color selection structure.

What is claimed is:

1. A color display tube comprising, in an evacuated envelope:

means for generating a number of electron beams;

a display screen having a large number of areas luminescing in different colors when struck by the beams, and a color selection structure positioned between the screen and the beam generating means, the selection structure including a multiplicity of apertures for associating each electron beam with luminescent areas of one color, the selection structure further including first and second lens electrode means, situated at a defined distance from each other, for focusing the electron beams passing through each aperture during normal operation of the tube, characterized in that at least one of the lens electrode means includes a plurality of mutually parallel elongate conductors and an electric resistance material interconnecting the conductors.

2. A tube as claimed in claim 1, characterized in that the color selection structure also includes a common voltage supply conductor connected to the elongate conductors by means of the electric resistance material.

3. A tube as claimed in claim 1, characterized in that the material has a resistance such that the resistance between two adjacent elongate conductors is at least 2000 ohms.

4. A tube as claimed in claim 1, characterized in that the material has a resistance such that the resistance between two adjacent conductors is at most $500\times10^3$ ohms.

5. A tube as claimed in claim 1, characterized in that the resistance material consists essentially of sodium silicate, iron oxide and graphite.

6. A tube as claimed in claim 1, characterized in that the resistance material consists essentially of potassium silicate, iron oxide and graphite.

7. A color display tube comprising, in an evacuated envelope:

means for generating a number of electron beams;

a display screen having a large number of areas luminescing in different colors when struck by the beams, and a color selection structure positioned between the screen and the beam generating means, the selection structure including a multiplicity of apertures for associating each electron beam with luminescent areas of one color, the selection structure further including first and second lens electrode means, situated at a defined distance from each other, for focusing the electron beams passing through each aperture during normal operation of the tube, characterized in that at least one of the lens electrode means includes a plurality of groups of mutually parallel elongate conductors and an electric resistance material interconnecting the groups.

8. A tube as claimed in claim 7, characterized in that the color selection structure further includes a common voltage supply conductor connected to the groups of elongate conductors by means of the electric resistance material.

9. A tube as claimed in claim 7, characterized in that the material has a resistance such that the resistance between two adjacent groups of elongate conductors is at least 2000 ohms.

10. A tube as claimed in claim 7, characterized in that the material has a resistance such that the resistance between two adjacent groups of conductors is at most $500\times10^3$ ohms.

11. A tube as claimed in claim 7, characterized in that the resistance material consists essentially of sodium silicate, iron oxide and graphite.

12. A tube as claimed in claim 7, characterized in that the resistance material consists essentially of potassium silicate, iron oxide and graphite.

13. A color display tube comprising, in an evacuated envelope:

means for generating a number of electron beams;

a display screen having a large number of areas luminescing in different colors when struck by the beams, and a color selection structure positioned between the screen and the beam generating means, the selection structure including a multiplicity of apertures for associating each electron beam with luminescent areas of one color, the selection structure further including first and second lens electrode means, situated at a defined distance from each other, for focusing the electron beams passing through each aperture during normal operation of the tube, characterized in that at least one of the lens electrode means includes a plurality of mutually parallel elongate conductors and an electric resistance material interconnecting the conductors, the material having a resistance such that the resistance between two adjacent conductors has a value in a range between $25\times10^3$ ohms and $500\times10^3$ ohms.

* * * * *

UNITED STATES PATENT AND TRADEMARK OFFICE

CERTIFICATE OF CORRECTION

PATENT NO. : 4,473,772

DATED : September 25, 1984

INVENTOR(S) : ABRAHAM A. DE KEIJZER

It is certified that error appears in the above—identified patent and that said Letters Patent is hereby corrected as shown below:

In the Title Page: In the Title, Change "STRUCURE" to --STRUCTURE--;

Col. 1, In the Title, Change "STRUCURE" to --STRUCTURE--;

line 24, after "tubes are" insert --,--;

Col. 2, line 37, after "therefore" insert --,--;

Col. 3, line 16, after "FIG. 1" insert --,--

Signed and Sealed this

*Fifth* Day of *November 1985*

[SEAL]

*Attest:*

DONALD J. QUIGG

*Attesting Officer*

*Commissioner of Patents and Trademarks*